US011007662B2

(12) United States Patent
Ruchet

(10) Patent No.: US 11,007,662 B2
(45) Date of Patent: May 18, 2021

(54) EJECTOR MEMBER AND MACHINE FOR PROCESSING SHEET-FORM ELEMENTS

(71) Applicant: BOBST MEX SA, Mex (CH)

(72) Inventor: Christophe Ruchet, Préverenges (CH)

(73) Assignee: BOBST MEX SA

( * ) Notice: Subject to any disclaimer, the term of this patent is extended or adjusted under 35 U.S.C. 154(b) by 187 days.

(21) Appl. No.: 16/083,285

(22) PCT Filed: Mar. 9, 2017

(86) PCT No.: PCT/EP2017/025045
§ 371 (c)(1),
(2) Date: Sep. 7, 2018

(87) PCT Pub. No.: WO2017/153056
PCT Pub. Date: Sep. 14, 2017

(65) Prior Publication Data

US 2019/0009422 A1 Jan. 10, 2019

(30) Foreign Application Priority Data

Mar. 9, 2016 (EP) ..... 16020072

(51) Int. Cl.
*B26D 7/18* (2006.01)
*B65H 29/00* (2006.01)
*B26F 1/40* (2006.01)

(52) U.S. Cl.
CPC ..... *B26D 7/1818* (2013.01); *B65H 29/003* (2013.01); *B26F 1/40* (2013.01)

(58) Field of Classification Search
CPC ..... B26D 7/1818; B26F 1/40; B65H 29/003; B31F 2201/0794; B31B 50/20; B31B 50/83; B31B 70/14; B31B 70/20
(Continued)

(56) References Cited

U.S. PATENT DOCUMENTS 2,126,214 A * 8/1938 Schelhammer ..... A45D 24/02 132/219
4,779,717 A * 10/1988 Eberle ..... B65H 29/003 101/408

(Continued)

FOREIGN PATENT DOCUMENTS

EP 1 867 449 A1 12/2007
FR 1 090 857 A 4/1955
WO WO 2012/038035 A1 3/2012

OTHER PUBLICATIONS

International Search Report dated May 17, 2017 in corresponding PCT International Application No. PCT/EP2017/025045.

(Continued)

*Primary Examiner* — Andrew M Tecco
*Assistant Examiner* — Nicholas E Igbokwe
(74) *Attorney, Agent, or Firm* — Ostrolenk Faber LLP

(57) ABSTRACT

An ejector member (2) for removing waste from sheets on the fly in a machine (1) for processing sheet-form elements includes a comb (4) having a plurality of teeth (10). The comb (4) is configured to be able to adopt a low-throughput first position and at least one high-throughput second position. The center of the comb (4) is set back with respect to the lateral ends of the comb (4) in the high-throughput second position. The center of the comb (4) is set back further in the high-throughput second position than in the low-throughput first position. Also relates a machine for processing sheet-form elements including such an ejector member.

16 Claims, 3 Drawing Sheets

(58) Field of Classification Search
USPC ..... 493/351–353, 340, 373
See application file for complete search history.

(56) References Cited

U.S. PATENT DOCUMENTS

| | | | | |
|---|---|---|---|---|
| 5,125,640 | A | 6/1992 | Yerly et al. | 271/204 |
| 5,154,689 | A * | 10/1992 | Modoux | B26D 7/1818 493/342 |
| 5,348,285 | A * | 9/1994 | Huser | B26D 7/018 271/183 |
| 5,562,279 | A | 10/1996 | Gillieron | 271/204 |
| 5,697,607 | A | 12/1997 | Pache | 271/204 |
| 6,427,633 | B1 * | 8/2002 | Ogden | A01K 13/002 119/600 |
| 7,237,479 | B2 * | 7/2007 | Pollien | B26D 7/015 100/151 |
| 7,331,915 | B2 | 2/2008 | Coullery et al. | 493/84 |
| 8,960,410 | B2 * | 2/2015 | Rebeaud | B65H 7/14 198/464.4 |
| 2003/0213498 | A1 * | 11/2003 | Gueret | A46B 9/028 132/218 |
| 2007/0296142 | A1 * | 12/2007 | Lappok | B65H 5/085 271/277 |

OTHER PUBLICATIONS

Written Opinion dated May 17, 2017 in corresponding PCT International Application No. PCT/EP2017/025045.

* cited by examiner

Fig.1
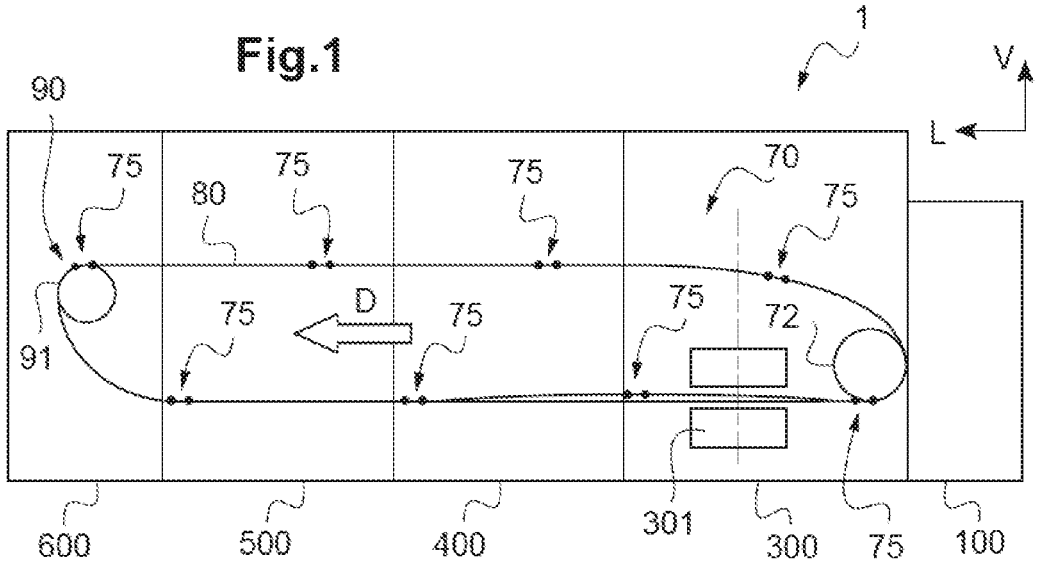
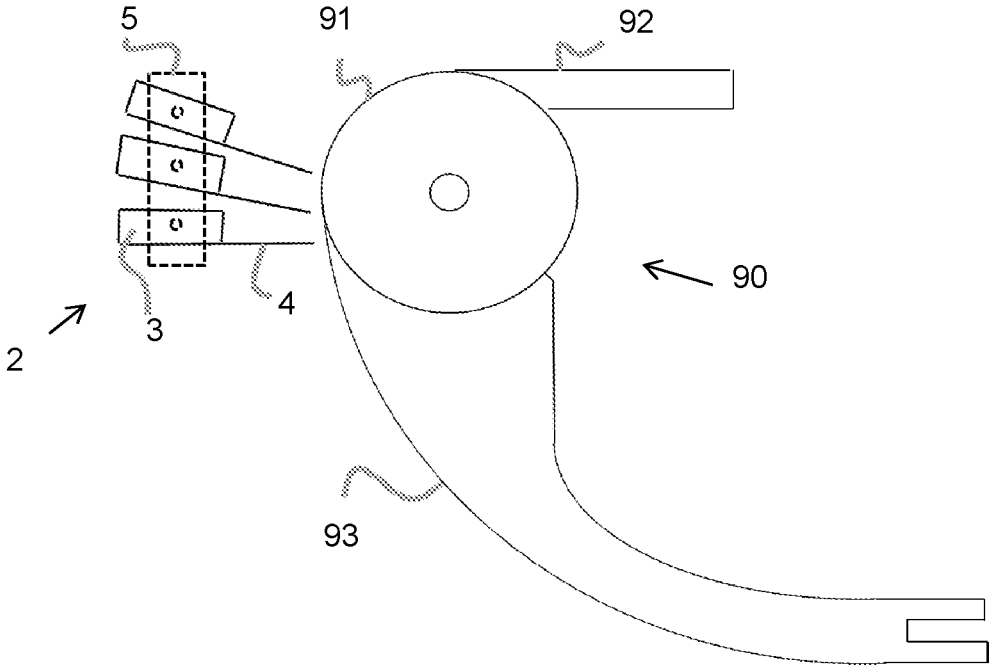
Fig.2

EJECTOR MEMBER AND MACHINE FOR PROCESSING SHEET-FORM ELEMENTS

CROSS-REFERENCE TO RELATED APPLICATIONS

The present application is a 35 U.S.C. §§ 371 national phase conversion of PCT/EP2017/025045, filed Mar. 9, 2017 which claims priority of European Patent Application No. 16020072.1, filed Mar. 9, 2016, the contents of which are incorporated by reference herein. The PCT International Application was published in the French language.

The present invention relates to an ejector member for removing waste from sheets on the fly in a machine for processing sheet-form elements. The invention also relates to a machine for processing sheet-form elements comprising such an ejector member.

BACKGROUND OF THE INVENTION

After shaping and ejecting the waste, separating copies involves severing the points attaching the copies on a sheet and receiving the copies in the receiving zone. The remaining part of the sheet, also referred to as the waste, remains gripped in the grippers of the gripper bar of the sheet transfer device so that the waste can be taken to the waste removal station.

A gripper bar and grippers on it is known in the art, as shown in the following United States patents, all incorporated by reference herein: U.S. Pat. Nos. 5,125,640; 5,562,279; 5,697,607; 7,237,479; 7,331,915; and 8,960,410.

The gripper bar is usually driven by two looped chains, and positioned respectively on one of the two sides of the punching press and to which the two ends of the gripper bars are fixed. A static ejector is arranged in the waste removal station in the form of a comb extending transversely with respect to the direction of travel of the waste transported by the gripper bar.

The path of the gripper bar is synchronized with its opening at the waste removal station so that on ascending the bend of the chainset loop, the grippers of the bar open as they intercept the ejector. The sheet carried by the gripper bar is released before it strikes the comb with the teeth which pass between the grippers of the gripper bar so that the sheet pivots onto the discharge belt.

Ejection is said to be "on the fly" because the about-turn path of the gripper bar in the waste removal station is employed directly in order to cause the cut sheet waste to pivot onto the discharge belt. Ejection on the fly makes it possible to save on a gripper bar. Specifically, without on-the-fly ejection, to remove the cut sheet waste from the gripper bar, the machine would need to comprise an additional waste-removal station in which the gripper bar would stop in order to set down the sheet of waste. The chainsets would then need to be lengthened by one additional gripper bar, which is expensive and takes up space.

This method of removing waste on the fly is effective provided that, once the gripper bar is open, the interception between the comb and the grippers allows the comb to come into contact with the sheet of waste and allows the grippers to pass between the teeth of the comb without the grippers contacting the teeth.

However, as the gripper bar performs its about-turn, it is subjected to a centrifugal force which increases intensity with the increase in machine throughput. At high throughput, such as at 10,000 sheets/hour and beyond, the gripper bar may deform under the effect of the centrifugal force. The conditions of interception between the gripper bar and the static ejector can then no longer be guaranteed and the waste removal functionality may therefore no longer be assured.

SUMMARY OF THE INVENTION

It is therefore an object of the present invention to propose an improved ejector member that makes it possible to guarantee on-the-fly ejection of waste at both low and at high throughput.

To this end, an ejector member for removing waste from sheets on the fly in a machine for processing sheet-form elements comprises a comb comprising a plurality of teeth. The comb is configured to be able to adopt at least a low-throughput first position and at least one high-throughput second position. The center of the comb is set back with respect to the lateral ends of the comb in the high-throughput second position, and the center of the comb is set back further in the high-throughput second position than in the low-throughput first position.

The position of the comb in the high-throughput second position when the gripper bar is deformed due to centrifugal force applied to the gripper bar in the high throughput second position, or in the position of the comb in the low-throughput first position when the gripper bar is straight makes it possible to adapt the curvature of the comb to suit the machine throughput, so that when the gripper bar and comb intercept one another, the shape of the comb best mimics the curvature of the moving gripper bar. The grippers are then in a better position to and can then pass between the teeth of the comb while the teeth strike the sheet waste at both of the center of the gripper bar as at the ends thereof, without the risk of collisions.

According to one or more features of the ejector member, considered alone or in combination,

- in the low-throughput first position, the overall shape of the comb is a straight line,
- in the high-throughput second position, the overall shape of the comb, which shape is concave is formed by at least two straight-line portions of the comb, which are connected by their ends; and the angle between two adjacent straight-line portions of the comb is less than 180°,
- in the high-throughput second position, the overall shape of the comb can be inscribed inside a triangle,
- in the high-throughput second position, the center of the comb is set back by a distance of between 1 and 5 millimeters with respect to the position of the center of the comb in the low-throughput first position,
- the comb comprises at least one deformable zone,
- the deformable zone is formed by a thinning and/or at least one orifice,
- the comb comprises at least one articulation,
- the comb comprises at least two straight-line portions joined together and able to move relative to one another,
- the ejector member comprises two straight-line portions joined together in the middle of the comb,
- the at least two straight-line portions are joined together and are joined to a base of the ejector member by at least three deformable zones of the comb,
- at rest, the comb is in a high-throughput second position,
- the ejector member comprises an actuating mechanism configured to cause the comb to adopt the low-throughput first position or a high-throughput second position,
- the ejector member comprises two supports configured to be fixed to a respective chainset guide device of the processing machine; the supports collaborate with a respective side plate borne by a base of the ejector member which is connected to the comb in order to fix the base to the supports with an inclination that can be modified in relation to the supports.

Another subject of the invention is a machine for processing sheet-form elements, the machine comprising an ejector member as described above, arranged on a chain guide device of a transport device of the processing machine downstream of a copies-receiving station of the processing machine.

BRIEF DESCRIPTION OF THE DRAWINGS

Further advantages and features will become apparent from reading the description of the invention and from studying the attached figures which depict one nonlimiting exemplary embodiment of the invention and in which:

FIG. 1 schematically illustrates one example of a machine for processing sheet-form elements.

FIG. 2 shows a side view of elements of an ejector member mounted on a transport device, for three different angular orientations of the ejector member.

DESCRIPTION OF EMBODIMENTS

Figure 3:
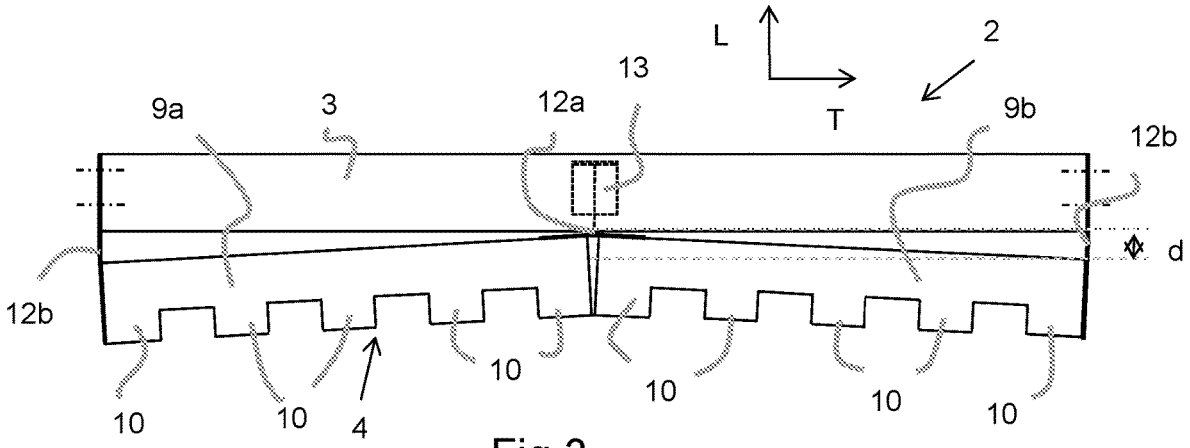
FIG. 3 shows the ejector member of FIG. 2 in a high-throughput second position.

In these figures, elements that are identical bear the same reference numerals. The following embodiments are examples. Although the description refers to one or more embodiments, this does not necessarily mean that each reference relates to the same embodiment or that features apply only to one embodiment. Simple features from various embodiments can also be combined or interchanged to form other embodiments.

The longitudinal, vertical and transverse directions are designated as indicated in FIGS. 1 and 3 by the trihedral frame of reference (L, V, T). The transverse direction T is the direction perpendicular to the longitudinal direction of travel of the sheets D. The horizontal plane corresponds to the (L, T) plane.

The terms upstream and downstream are defined with reference to the direction of travel of the board or sheet elements, as illustrated by the arrow D in FIG. 1. These elements move from upstream to downstream, generally along the longitudinal main axis of the machine, in a movement paced by periodic stoppages.

The terms "flat elements" and "sheets" are considered to be equivalent. They will relate to any of elements made of corrugated board as to flat board, paper or any other material commonly used in the packaging industry. The terms "sheet" or "sheet element" or "sheet-form element" relate very generally to any print medium in sheet form, for example, sheets of board, paper, plastic, etc.

FIG. 1 depicts one example of a processing machine 1 for converting sheets. This processing machine 1 is made up in the conventional way of several workstations which are juxtaposed but interdependent on one another to form a unit assembly. Thus there are a feed station 100, a conversion station 300 for cutting the sheets, such as a station comprising a platen press 301, a waste ejection station 400, a copy separation station 500 where the converted sheets are reorganized into a pile and a waste removal station 600 where the cut sheet waste (generally in the form of a grid) are removed on the fly. The invention particularly concerns the waste removal station 600 and an improved construction that improves discharge of sheet waste.

The operation of converting each sheet takes place in the conversion station 300, for example between a fixed platen and a lower platen of the platen press 301, wherein the platen are mounted with the ability to move, for cutting the sheets to a template corresponding to the developed shape that is to be obtained, for example to obtain a plurality of boxes of a given shape. The mobile platen is successively raised and lowered once per machine cycle.

A transport device 70 is configured to move each sheet 7 individually from the exit of the feed station 100 as far as the waste removal station 600 via the press-involving conversion station 300. At some stages, part of each gripped sheet is removed. At the final station 600, the remainder of the sheet 7 still being gripped by the gripper 76 is now sheet waste. The sheet waste is ejected from the station 600 on the fly after it is released from its grippers.

The transport device 70 comprises a plurality of transverse bars which are provided with grippers, and which are commonly referred to as gripper bars 75. Each gripper bar in turn grips a sheet along the front or leading edge, before pulling the sheet in succession into and through the various workstations 300, 400, 500, 600 of the machine 1.

The ends of the gripper bars 75 are each respectively connected to a loop-forming lateral chain, commonly referred to as a chainset 80. Two chainsets 80 are thus arranged laterally on each side of the gripper bars 75.

The transport device 70 also comprises at least one chain guide device 90 configured to guide a respective chainset 80.

Because of a movement transmitted to the chainsets 80 at driving sprockets 72, all of the gripper bars 75 will in sequence leave a stopped position, accelerate, attain a maximum speed, decelerate, and will then stop, describing a cycle corresponding to movement of a sheet from one workstation to the next workstation. The chainsets 80 move and stop periodically. During each movement, all of the gripper bars 75 move on from one station to the adjacent workstation downstream. Each station performs its work in synchronism with this cycle which is commonly referred to as the machine cycle.

The number and nature of processing stations in a processing machine 1 can vary according to the nature and complexity of the operations to be performed on the sheets. Within the context of the invention, a processing machine defines a very wide variety of embodiments because of the modular nature of these assemblies. Depending on the number, nature and layout of the workstations used, it is possible to obtain a multitude of different processing machines. There are other types of workstations than those mentioned above, such as embossing or scoring stations, stations for loading stamping tapes for stamping or hot foil stamping machines, of which patterns are created between the platens of a press by applying to each sheet from one or more stamping tapes. Finally, the same processing machine may be equipped with a number of stations of one type.

Elements of a transport device 70 are schematically indicated in FIG. 1. This Figure shows the plurality of gripper bars 75, eight in this example, that allow the sheets to be moved to and through the various workstations 300, 400, 500, 600 of the machine 1. A chainset 80 and a chain guide device 90 are arranged in the waste discharge station 600 downstream of the copies separation station 500. The driving sprockets 72 that drive the chainsets 80 are arranged on the opposite side, near the feed station 100.

In FIG. 2, each chain guide device 90 comprises, for example, a pulley 91 or a sprocket wheel or a simple guide of cylindrical shape. Each chain guide also comprises an upper chain guide 92 arranged substantially horizontally in the machine 1 to guide the chainset 80 as it leaves the pulley 91 to the right in FIG. 2 and a lower chain guide 93 of curved shape to guide the chainset 80 to the left in FIG. 2 through a bend in the loop toward the pulley 91. The chain guide devices 90 at both sides may be connected to one another by a transverse shaft of the machine 1 or may be connected separately to a moving part on each side.

Figure 4:
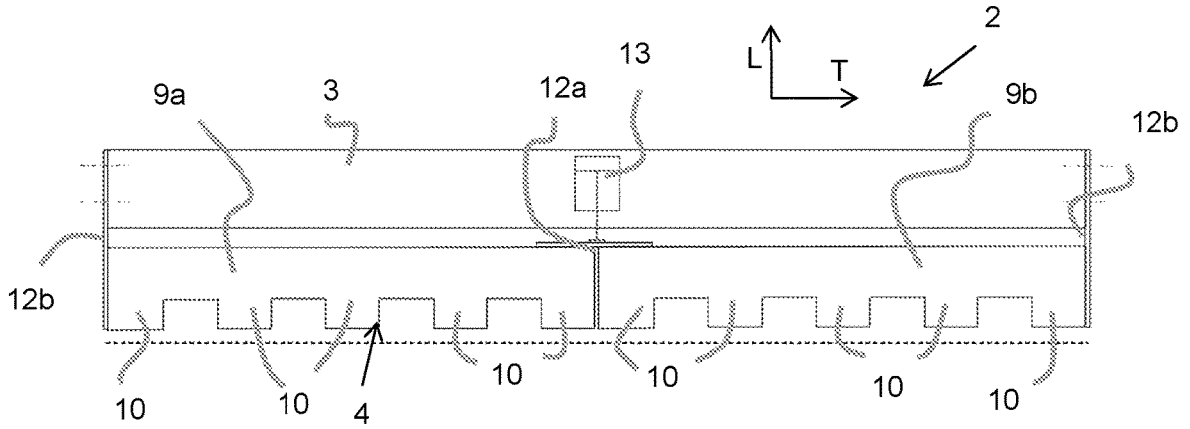
FIG. 4 shows the ejector member of FIG. 2 in a low-throughput first position.

The waste discharge station 600 comprises an ejector member 2 in FIGS. 2-4 for discharging on the fly cut-sheet waste from the front edge the sheet which is engaged with the gripper bar 75.

The ejector member 2 comprises a base 3, a comb 4 connected to the base 3 and two lateral supports 5 which are configured to be fixed to a respective chainset guide device 90 for example to a chain guard for the lower chain guide 93 (not depicted). The ejector member has a single comb. Three orientations of a comb 4 are illustrated to show three locations, heights and orientations of a single comb in that machine.

The base 3 has for example a hollow parallelepipedal overall shape, for example made of sheet metal. The base 3 for example bears side plates extending vertically and collaborating with the supports 5.

The comb 4 comprises a plurality of teeth 10, ten in this example in FIGS. 3 and 4. The teeth 10 have substantially identical dimensions and are evenly spaced so as to allow the passage of the grippers of the gripper bars 75 through the spaces interposed between the teeth 10. The number and positions of the teeth 10 may vary according to the type of gripper bar used.

Figure 5:
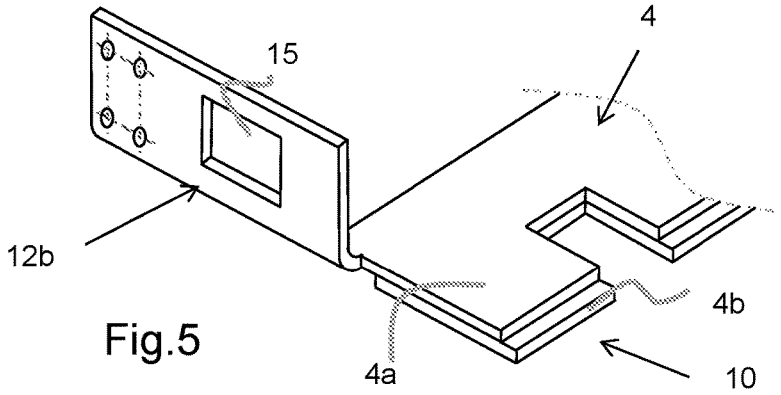
FIG. 5 shows an enlarged view of a deformable end zone of a comb of the ejector member.
Figure 6:
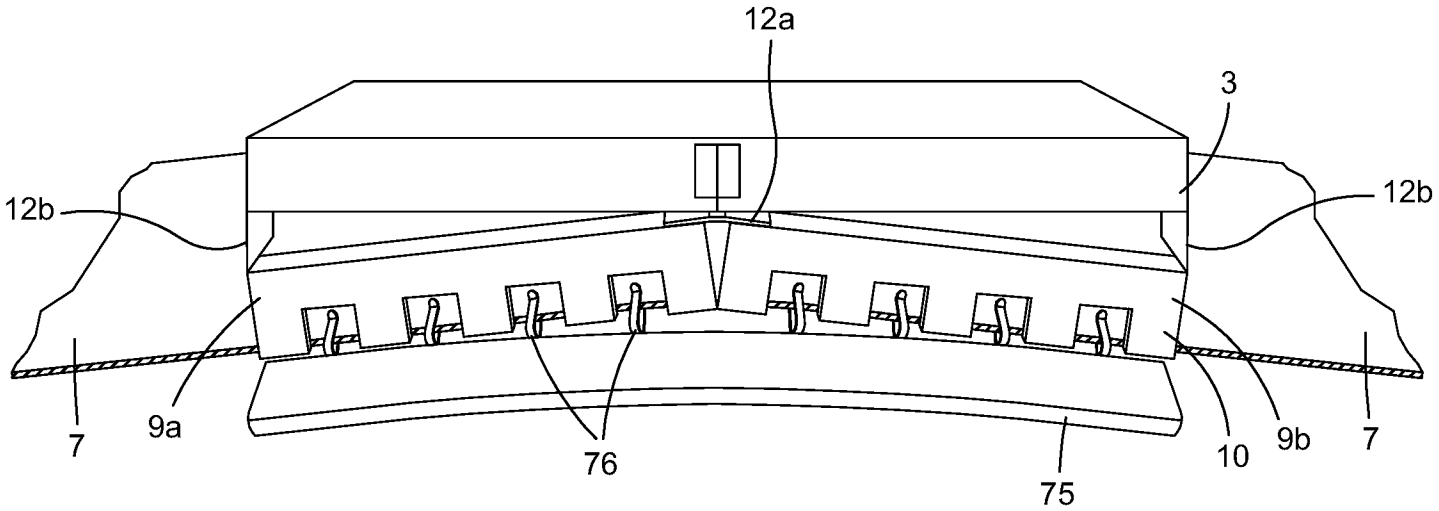
FIG. 6 shows the gripper bar and the comb in a high-throughput position, with the grippers that pass though the comb.

The comb 4 is for example formed of two separate materials, for example superposed in plies, as seen in FIG. 5. The teeth 10 comprise for example a plastic material 4*a* at the lower part, making it possible to limit the noise of impact and a metallic material 4*b* in the upper part, providing good mechanical strength.

The supports 5 are configured to collaborate with a respective side plate borne by the base 3 to fix the base 3 with modifiable inclination with respect to the supports 5 (FIG. 2). The inclination of the comb 4 may thus be oriented according to the thickness of the waste sheet, which makes it possible to ensure that the grippers of the gripper bar 75 are sufficiently open when they intercept the teeth 10 of the comb 4. The thicker is the sheet being transported, the higher are teeth of the comb raised to handle the sheets.

According to one embodiment, the ejector member 2 is configured to be able to incline by a predefined number of distinct orientations allowing different thicknesses of board to pass. FIG. 2 thus illustrates an example for three angular positions that a single ejector member 2 can adopt according to the thickness of the sheet waste.

The comb 4 is also configured to be able to adopt a low-throughput first position (FIG. 4) and at least one high-throughput second position (FIG. 3).

In the low-throughput first position of FIG. 4, the comb 4 extends for example in a line in the transverse direction T perpendicular to the longitudinal direction of travel of the sheet-form elements D. The comb 4 in the low-throughput first position thus has, for example, a straight line or substantially straight-line overall shape that complements that of the gripper bar 75 for a machine 1 operating at low throughput, for example for a machine throughput below a predetermined throughput threshold, such as of the order of 10,000 sheets/hour (s/h).

In the high-throughput second position of FIG. 3, the shape of the comb 4 is pulled back or upstream in the path of the gripper bars into a concave shape. The center of the comb is set back in relation to its lateral ends in the longitudinal direction of travel of the sheet-form elements D. In this high-throughput second position, the center of the comb 4 is set back further than in the low-throughput first position.

The center of the comb 4 is set back by a distance d for example of between 1 and 5 millimeters, such as of the order of 3 mm, with respect to the low-throughput first position. The curvature of the comb 4 in the pulled-back position has a shape that approximates to the curvature of the gripper bar 75 in movement for a machine 1 operating at a high throughput, namely for a machine throughput above the predetermined throughput threshold.

The position of the comb 4 in the high-throughput second position when the gripper bar 75 is deformed or in the low-throughput first position when the gripper bar 75 is straight, makes it possible to adapt the curvature of the comb 4 to suit the machine throughput so that when the gripper bar 75 and the comb 4 are about to intercept each other, the shape of the comb 4 best matches the curvature of the moving gripper bar 75. The grippers can therefore pass between the teeth 10 of the comb 4 while the teeth strikes the sheet waste in the center of the gripper bar 75 and also at the ends of the gripper bar without the risk of collisions between the grippers and the comb.

The comb 4 may be configured to adopt a low-throughput first position and a single high-throughput second position. It is also conceivable for the comb 4 to be able to adopt several high-throughput second positions, with a concavity accentuated to greater or lesser extents according to the machine throughput in order to best match the shape of the gripper bar 75, which shape is itself dependent on the machine throughput.

In the high-throughput second position, the overall shape of the comb 4, which is concave, may be formed by at least two straight-line portions 9*a*, 9*b* connected by their ends. The angle between two adjacent straight-line portions 9*a*, 9*b* is less than 180°.

The concave overall shape of the comb 4 may thus be formed by two straight-line portions 9*a*, 9*b* placed end to end. The overall shape of the comb 4 may be inscribed inside a triangle, as seen in FIG. 3. The triangle inside which the overall shape of the comb 4 can be inscribed is thus formed by the two straight-line portions 9*a*, 9*b* joined together at the lateral ends of the comb 4 by a transverse straight line. This shape is particularly simple to achieve.

The comb 4 for example comprises at least two rigid straight-line portions 9*a*, 9*b* which can also move relative to one another. The straight-line portions 9*a*, 9*b* are joined together and to the base 3 by at least three connections produced for example using articulations or deformable zones of the comb 4 or by using at least one articulation and at least one deformable zone.

The comb 4 for example comprises at least one deformable zone 12*a*, 12*b* for joining the straight-line portions 9*a*, 9*b* together and/or to the base 3. A deformable zone 12*a*, 12*b* may be created through a zone of weakness formed by thinning and/or at least one orifice 15. Other embodiments for the deformable zones are conceivable, for example the insertion of flexible materials.

The comb 4 may comprise at least one articulation for connecting the straight-line portions 9*a*, 9*b* together and/or to the base 3, such as an articulation of the link rod, pivot link, hinge, slide rail or other type (not depicted).

According to one exemplary embodiment, the comb 4 comprises at least two straight-line portions 9*a*, 9*b* joined together and to the base 3 by at least three deformable zones 12*a*, 12*b*. Two straight-line portions 9*a*, 9*b* are, for example, joined together at the middle of the comb 4. Each straight-line portion 9*a*, 9*b* thus has the same number of teeth 10.

The deformable zones 12*b* connecting the base 3 to the lateral ends of the comb 4 may be formed by a perforated respective wall (FIG. 5). These deformable zones 12*b* also react to the load generated by the impact of the waste sheet.

The deformable zone 12*a* situated in a central position between the straight-line portions 9*a*, 9*b* is, for example, formed by a perforated wall of small thickness, of the order of a few millimeters.

Because of the very small angular deformation of the walls of the deformable zones 12*a*, 12*b* of the comb 4, of the order of 0.5 degrees, a comb 4 exhibiting a deformable structure made of zones of weakness is advantageous because it is very simple to create, is inexpensive, exhibits a low number of component parts, has no pivot point wear and is free of play.

It may thus be envisioned for the comb 4 to have a higher number of deformable zones or articulations arranged in such a way that, in the high-throughput second position, the comb 4 exhibits a more curved concave shape best conforming to the deformed shape of the gripper bar 75.

The overall shape of the comb 4 in the high-throughput second position may thus for example comprise more than two straight-line portions 9*a*, 9*b* connected by their ends, such as three straight-line portions which can be inscribed in a trapezoidal overall shape. The trapezoidal outline inside which the overall shape of the comb 4 can be inscribed is thus formed by three straight-line portions placed end to end and connected to the lateral ends of the comb 4 by a transverse straight line.

The comb 4 is, for example, configured to adopt a high-throughput second position at rest. Force then needs to be exerted on the comb 4 in order to cause it to adopt the low-throughput first position. Defaulting to the high-throughput second position makes it possible to ensure that waste from sheets can be ejected at high throughput even in the event of a problem, such as in the event of a power cut or the like.

The ejector member 2 comprises for example at least one actuating mechanism configured to cause the comb 4 to adopt the low-throughput first position or the high-throughput second position by deforming the comb 4 or by moving at least one straight-line portion 9*a*, 9*b* of the comb.

The actuating mechanism is for example configured to push longitudinally on a deformable central zone 12*a* of the comb 4 in order to straighten it into the low-throughput first position. This also makes it possible to react to vertical loads and ensure the lateral positioning of the comb 4.

According to one exemplary embodiment, the actuating mechanism comprises at least one actuator 13, such as a pneumatic cylinder. The mobile end of the actuator 13 is fixed to the deformable central zone 12*a* for example by screws arranged between two zones of weakness. Pneumatic operation of the cylinder pushes the wall of the deformable zone 12*a* back longitudinally to straighten the comb 4 into the low-throughput first position.

The actuator 13 is carried on board the device. It is for example housed and fixed in the base 3.

In instances in which the comb 4 exhibits more than two straight-line portions 9*a*, 9*b*, the ejector member 2 may comprise several actuators 13. Alternatively, the actuator 13 may be configured to deform several deformable zones 12*a*, 12*b* at a time, or to move several straight-line portions 9*a*, 9*b* at a time.

According to another example which has not been depicted, the actuating mechanism comprises a transmission device that can be actuated manually by an operator, such as a device involving fork, linkages and/or chains or belts, to offset actuation to a zone accessible to the operator, which can be actuated between two, low-throughput and high-throughput, positions, for example by means of a lever or of a handwheel.

In operation, the path of the gripper bar 75 is synchronized with the grippers opening their grippers in the waste discharge station 600 so that as the gripper bar 75 ascends the bend of the loop of the chainsets 80, the grippers open as they intercept the ejector member 2. The waste is carried by the gripper bar 75, and the grip by the gripper is released before the striking of the comb 4 and with the teeth 10 passing between the grippers of the gripper bar 75 so that it pivots onto the discharge belt.

Ejection "on the fly" uses the about-turn path of the gripper bar 75 in the waste discharge station 600 to cause the cut sheet waste to pivot onto the discharge belt, thus making a saving on one gripper bar. This method of discharging waste on the fly can work just as well at low as at high throughput because the curvature of the comb 4 can be modified to suit the machine throughput by causing it to adopt a low-throughput first position or at least one high-throughput second position.

The invention claimed is:

1. An ejector member for removing waste on the fly from sheets in a machine for processing sheet-form elements, the ejector member comprising:

a comb comprising a center, lateral ends, and a plurality of teeth, the comb is configured to adopt a low-throughput first position and at least one high-throughput second position, and the comb in the high-throughput second position has an overall concave shape such that the center of the comb is set back with respect to the lateral ends of the comb;

wherein the center of the comb is set back further in the high-throughput second position than in the low-throughput first position.

2. An ejector member according to claim 1, wherein in the low-throughput first position the overall shape of the comb is a straight line.

3. An ejector member according to claim 1, wherein in the high-throughput second position; the overall shape of the comb is formed by at least two straight-line portions connected by their adjacent ends, and the angle between the at least two adjacent straight-line portions is less than 180°.

4. An ejector member according to claim 3, wherein in the high-throughput second position, the overall shape of the comb can be inscribed inside a triangle.

5. An ejector member according to claim 3, wherein in the high-throughput second position, a center of the comb is set back by a distance of between 1 and 5 millimeters with respect to a position of the center of the comb in the low-throughput first position.

6. An ejector member according to claim 3, wherein it comprises two straight-line portions joined together in the center of the comb.

7. An ejector member according to claim 1, wherein the comb comprises at least one deformable zone along a length of the comb.

8. An ejector member according to claim 7, wherein the deformable zone is formed by a thinning and/or at least one orifice.

9. An ejector member according to claim 7, wherein the comb comprises at least one articulation.

10. An ejector member according to claim 1, wherein the comb comprises at least two straight-line portions joined together and able to move relative to one another.

11. An ejector member according to claim 10, wherein the at least two straight-line portions are joined together and are joined to a base of the ejector member by at least three deformable zones of the comb.

12. An ejector member according to claim 1, wherein at rest, the comb is in a high-throughput second position.

13. An ejector member according to claim 1, further comprising two supports configured to be fixed to a respective chainset guide device of the processing machine, the supports being configured for collaborating with a respective side plate borne by a base of the ejector member and the side plate is connected to the comb in order to fix the base to the supports with an inclination that can be modified in relation to the supports.

14. A machine for processing sheet-form elements, the machine comprising an ejector member according to claim 1, arranged on a chain guide device of a transport device of the processing machine downstream of a copies-receiving station of the processing machine.

15. An ejector member for removing waste on the fly from sheets in a machine for processing sheet-form elements, the ejector member comprising:

a comb comprising a center, lateral ends, and a plurality of teeth, the comb is configured to be able to adopt a low-throughput first position and at least one high-throughput second position;

the center of the comb in the high-throughput second position being set back with respect to the lateral ends of the comb such that the center of the comb is set back further in the high-throughput second position than in the low-throughput first position; and an actuating mechanism configured to cause the comb to adopt either the low-throughput first position or the at least one high-throughput second position.

16. The ejector member according to claim 15, wherein the actuating mechanism is configured to cause the comb to adopt the first or second positions by deforming at least a portion of the comb.

* * * * *